US007720244B2

(12) United States Patent
Espersen et al.

(10) Patent No.: US 7,720,244 B2
(45) Date of Patent: May 18, 2010

(54) EARPIECE FOR A HEARING AID AND A HEARING AID

(75) Inventors: Christian Bohl Espersen, Ballerup (DK); Jorgen Mejner Olsen, Hillerod (DK)

(73) Assignee: Widex A/S, Lynge (DK)

( * ) Notice: Subject to any disclaimer, the term of this patent is extended or adjusted under 35 U.S.C. 154(b) by 925 days.

(21) Appl. No.: 11/374,163

(22) Filed: Mar. 14, 2006

(65) Prior Publication Data

US 2006/0215864 A1 Sep. 28, 2006

Related U.S. Application Data

(60) Provisional application No. 60/661,917, filed on Mar. 16, 2005.

(51) Int. Cl.
*H04R 25/00* (2006.01)

(52) U.S. Cl. ..... 381/330; 381/328; 381/381

(58) Field of Classification Search ..... 381/322, 381/325, 327–328, 330, 380, 381; 379/430
See application file for complete search history.

(56) References Cited

U.S. PATENT DOCUMENTS 2,545,731 A * 3/1951 French ..... 381/380
3,915,166 A 10/1975 McCrink et al
3,934,100 A 1/1976 Harada et al.
4,381,830 A * 5/1983 Jelonek et al. ..... 381/330
5,737,436 A * 4/1998 Boyden ..... 381/330
5,975,235 A * 11/1999 Schlaegel et al. ..... 181/129
6,009,183 A * 12/1999 Taenzer et al. ..... 381/330
7,203,331 B2 * 4/2007 Boesen ..... 381/380
7,570,777 B1 * 8/2009 Taenzer et al. ..... 381/381
2002/0096391 A1 7/2002 Smith et al.
2003/0002700 A1 1/2003 Fretz et al.

FOREIGN PATENT DOCUMENTS

EP 1448014 A1 8/2004

OTHER PUBLICATIONS

International Search Report Jan. 1 2006 PCT/DK2005/000563 (published as W02006/062988).

* cited by examiner

*Primary Examiner*—Suhan Ni
(74) *Attorney, Agent, or Firm*—Sughrue Mion, PLLC

(57) ABSTRACT

An earpiece (2) for a hearing aid (12) comprises a plug (20) for contacting the meatus of the users ear canal, a contact element (13) for resting against an inside of the users tragus and or the ear canal, and a fixture for holding the plug and the contact element together, the fixture having means for adjusting the spacing between the plug and the contact element. The invention further provides a hearing aid.

19 Claims, 14 Drawing Sheets

EARPIECE FOR A HEARING AID AND A HEARING AID

RELATED APPLICATIONS

The present application claims the benefit of U.S. Provisional Patent Application Ser. No. 60/661,917, filed Mar. 16, 2005, which is incorporated herein by reference.

BACKGROUND OF THE INVENTION

1. Field of the Invention

The present invention relates generally to hearing aids. The invention further relates to an earpiece for a hearing aid. The invention, more particularly, relates to behind-the-ear hearing aids.

2. The Prior Art

Behind-the-ear (BTE) hearing aids generally comprise a housing, a tube and an earpiece. The housing accommodates electronics, a microphone and a miniature loudspeaker, which serve to pick up sounds, amplify them and produce an amplified acoustic output signal. The tube provides a conduit for conveying the acoustic signal from the housing to the earpiece, and the earpiece couples acoustic energy from the tube into the ear canal. In use, the housing is placed behind the external ear, partially concealed. The tube, or at least a part of it, is semi-rigid or resilient in order that the tube may also serve the purpose of resting the hearing aid on the external ear of the user. The earpiece is adapted, e.g. through resilience or customization, to the users ear, to rest in the meatus of the ear canal.

EP-A-1448014 provides an earpiece adapted to allow sounds from outside the ear to propagate to the tympanic membrane. This earpiece comprises a resilient fiber for abutting a lower part of the concha when the earpiece is inserted in the ear canal.

SUMMARY OF THE INVENTION

It is an object of the invention to provide a hearing aid that is easily adapted to different users.

It is a further object of the invention to provide a hearing aid that is simple in manufacture.

It is a still further object to provide a hearing aid with excellent and comfortable retention on the user.

It is yet a further object of the invention to provide a hearing aid that provides a good acoustical coupling to the users ear canal.

It is another object of the invention to provide a hearing aid that is partially open to permit sounds to reach the users tympanic membrane, alongside feeding amplified sounds to also reach the users tympanic membrane.

It is still another object of the invention to provide an earpiece for a hearing aid that is simple in manufacture and that is easily adapted to different users and types of hearing aids.

These and other objects are fulfilled, according to a first aspect of the invention, by an earpiece for a hearing aid, the ear piece comprising a plug for contacting the meatus of the users ear canal, a contact element for resting against at least one of an inside of the users tragus and the ear canal, means for adjusting the contact element, and a fixture for holding the plug and the contact element together.

The plug provides a comfortable, partial support for the earpiece and is adapted to direct sounds amplified by the hearing aid towards the users ear canal. The support is complemented by the contact element, which rests against another part of the ear. According to the invention, the fixture permits adjusting the contact element and thereby permits adapting the hearing aid to different sizes of ears and ear canals, or to different preferences regarding pretension. The adjustment facility permits customizing the hearing aid in order that it may accommodate a wide variety of users.

In an embodiment of the invention, the contact element may be partially shaped as an ellipse. It may have any other shape adapted for resting against an inside of the users tragus, thereby holding the earpiece in a fixed position when the earpiece is in use, e.g. it may be essentially circular, elliptic or triangular. The contact element may be produced in different sizes for different sizes of ears.

In a further embodiment of the invention, the fixture comprises a number of guideways. The number may be between 1 and 50. The guideways may be grooves, flutes or protrusions. Further the contact element may comprise a number of guideways adapted for interaction with the guideways on the fixture. The number of guideways may be between 1 and 50. The guideways may be grooves or protrusions. The guideways allow the contact element to be rotated into a selected orientation relative to the earplug, thereby enabling a fitter to select the most comfortable position of resting against an inside of the user's tragus and the ear canal. Furthermore the rotational capability allows for adjusting and fixing the position of the contact element in the ear for a variety of users.

According to an embodiment, the fixture comprises resilient means in order to improve user comfort and to enhance the fit.

According to a further embodiment, the earpiece is adapted for incremental adjustment. The incremental adjustment permits adaptation and simple securing of the size, once decided by the fitter or the end user.

The adjustment may be provided by providing a flexible beam, such as a branch or a rod, with a plurality of grooves and a catch means for selectively engaging one of the grooves.

The beam may comprise a pair of opposing, generally flat faces, wherein the plurality of grooves is positioned on a first one of the faces. The flat opposing faces adapt the beam for bending, e.g. into a loop.

The fixture may comprise catch means to retain an end of the beam.

According to an embodiment, the catch means comprises a rib and a resilient strand, the rib being adapted for engaging one of the grooves. This design is simple in manufacturing and it provides easy adaptation and securing.

According to a further embodiment, the beam is provided with a plurality of grooves on both of the faces. This permits looping the beam either way, e.g. for the purpose of using it for a left ear version and a right ear version, e.g. in combination with the retainer being adapted to accept the end of the beam when entered from either one of two sides. In a further embodiment the beam may be provided with a plurality of grooves on all of the faces, this provides for a better fixation of the beam. The grooves may be placed with increments varying between 0.5 mm and 5 mm and preferably between 1.5 mm and 2.5 mm.

According to an embodiment, the earpiece comprises a body with an axis and a through axial bore, wherein the flexible beam extends from the body at an angle from the axis within a range of 45 to 90 degrees, and preferably within a range of 55 to 80 degrees from the axis. This permits adapting the earpiece for deep recession into the ear canal as the beam may partially protrude to engage the users concha behind tragus and the ear canal. The body may be generally cylindrical. Provided the beam is flexible, the retainer may simply be arranged to accept the beam end when introduced tangentially to the cylindrical body from either one of two sides, the beam being twisted due to the angled extension of the cantilevered base end.

According to an embodiment, the fixture is made of a material selected from the group consisting of polyamide, silicone, polyurethane, polytetrafluoroethylene, ethylvinylacetate, polyacetal, thermoplastic elastomer, polymer, elastomer, and polyoxymethylene.

According to a further embodiment, the earpiece comprises a plug for contacting the wall of the users ear canal, in order to guide the amplified sound signal into the users auditory canal.

According to still another embodiment, the plug is adapted to support a sound conduit tube, while it is adapted to permit exterior sounds to bypass the plug in order to reach the users inner ear. This avoids uncomfortable occlusion effects. The sound bypass is further a substantial advantage to users with a mild hearing deficiency, e.g. users with a hearing deficiency in only part of the frequency range, as they may then still directly hear such sounds as they are able to hear unaided.

According to another embodiment the plug may be adapted to fit the ear canal, thereby not allowing external sounds to bypass the plug. This may be an advantage for moderate to high hearing loss.

The invention, in a second aspect, provides a hearing aid comprising an earpiece, a housing, and a sound conduit tube, wherein said ear piece has a plug for contacting the meatus of the users ear canal; a contact element for resting against at least one of an inside of the users tragus and the ear canal; means for adjusting the contact element; and a fixture for holding the plug and the contact element together.

Further embodiments appear from the dependent claims.

Further objects, embodiments and advantages will appear from the detailed part of the specification.

BRIEF DESCRIPTION OF THE DRAWINGS

The invention will now be described in more detail with reference to the accompanying drawings, where.

DETAILED DESCRIPTION OF THE INVENTION

Figure 1:
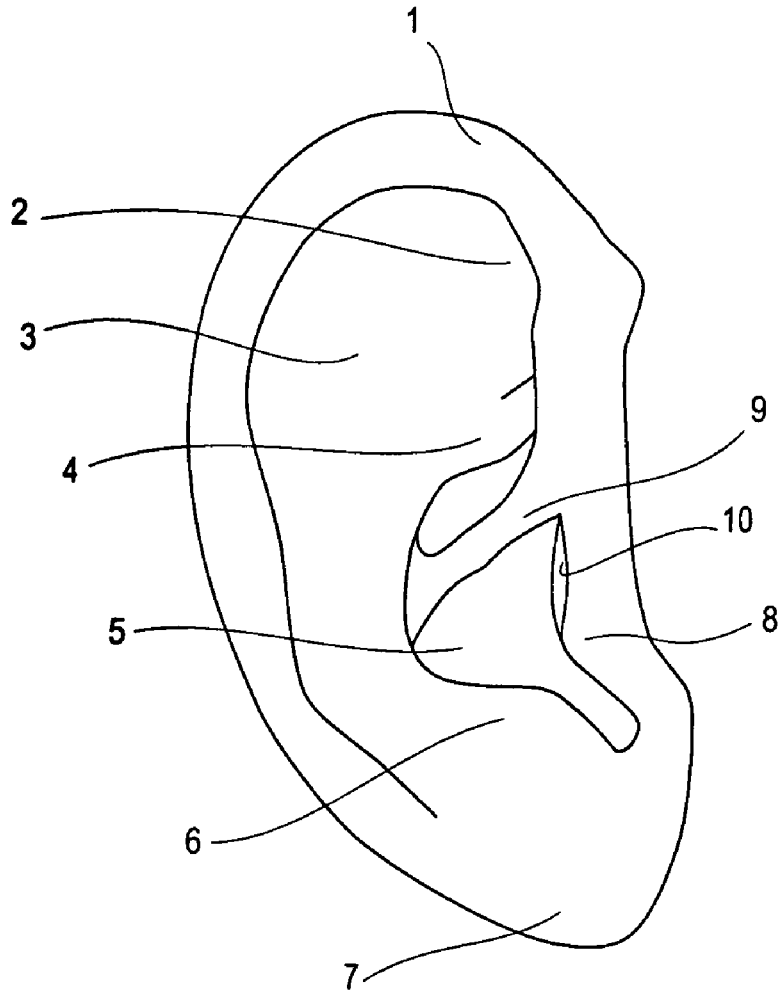
FIG. 1 illustrates the outer ear as seen from the side.
Figure 2:
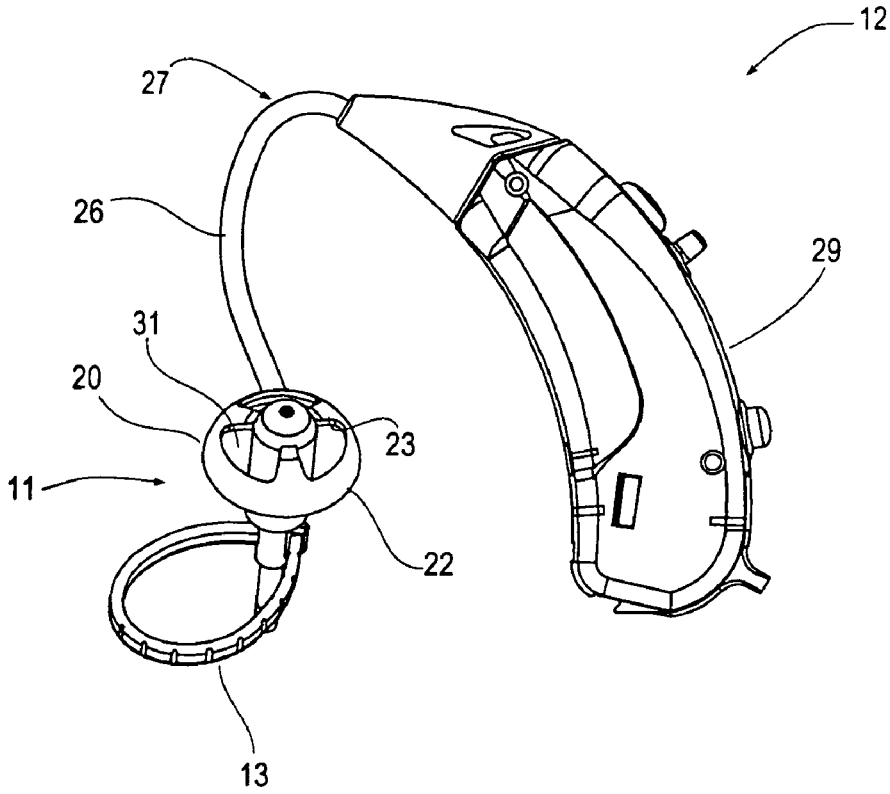
FIG. 2 shows a hearing aid according to a first embodiment of the invention, in side view.
Figure 3:
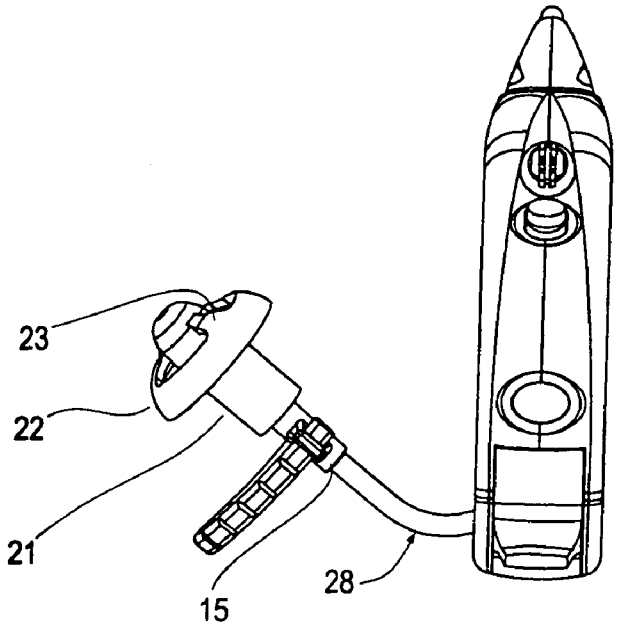
FIG. 3 shows a hearing aid according to a first embodiment of the invention, in rear view.
Figure 4:
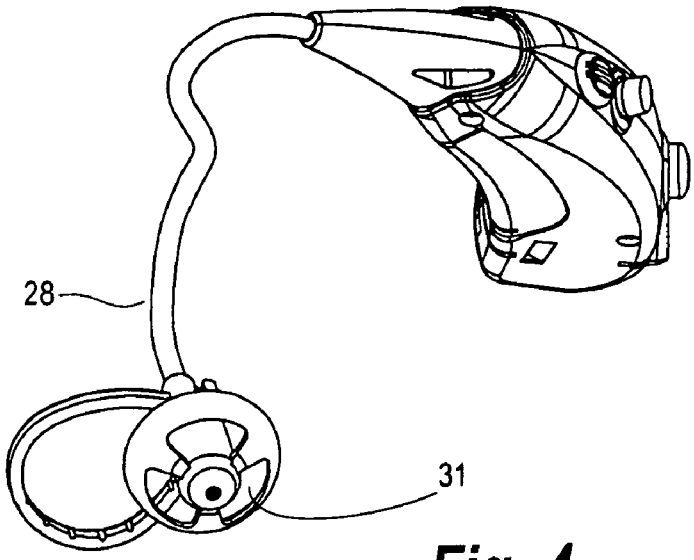
FIG. 4 shows a hearing aid according to a first embodiment of the invention, in perspective.

Reference is first made to FIG. 1, which shows the outer ear. In the figure the ear canal 10 and tragus 8 are shown. The outer portion of the ear canal is relatively soft. FIG. 1 further shows Helix 1, Fossa of Helix 2, Antihelix 3, Crus Antihelix 4, Concha (cavuum) 5, Antitragus 6, Lobule 7, and Crus helices 9.

Reference is now made to FIGS. 2-5, which show a hearing aid 12 with an earpiece 11, according to a first embodiment of the invention. The hearing aid comprises a behind-the-ear housing 29 and a tube 26 transferring sound from the housing to the earpiece 11. The tube 26 has a first bend 27 and a second bend 28. The tube 26 is connected at one end with the housing and at the other end with the earpiece 11

The earpiece generally comprises a peg 15, an earplug 20 and a body 21. The cross section of the body may be circular, elliptic, rectangular or any other form allowing sound from the tube to pass through to the earplug. The earplug 20 allows sound from the surroundings to pass through to the tympanic membrane by one, two or more apertures 31. The body 21, a rim 22, and a number of spokes 23 define the apertures. The peg engages the earplug 20 by threading into a through bore of the plug, the peg having a bead 19 for securing the position.

Figure 5:
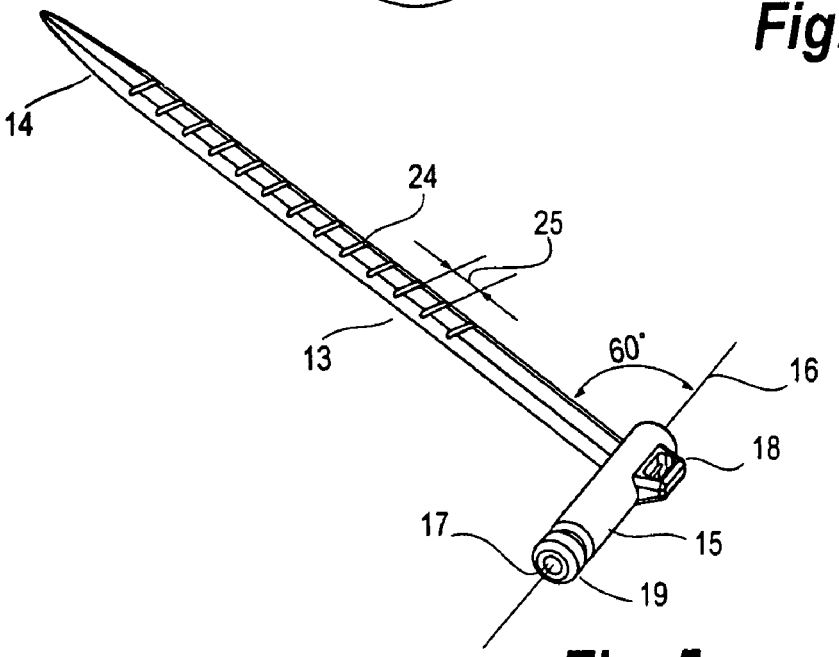
FIG. 5 shows a fixture for the earpiece according to a first embodiment of the invention, in a first state.

FIG. 5 shows a branch 13 connected with the peg 15, in a first state. The branch comprises a beam-like structure protruding generally radially from the peg. The branch is flexible in order that it may be formed into a loop, an exterior side of the loop providing support against the users ear when the earpiece is fitted into the ear. The peg 15 has a bore 17 that allows sound from the tube to pass through to the earplug. The peg 15 further has a branch 13 and a retainer 18 in form of an eyelet. The branch 13 has a pointed end 14. The branch 13 extends from the peg by a first, cantilevered end, and threads by its other, pointed end into the retainer 18. The branch 13 is a beam like structure with two generally flat opposing faces, each provided with a number of transverse grooves 24, placed along the branch 13 at increments 25 of 2 mm. The grooves are 1.65 mm wide. The length of the branch 13 from the peg to the pointed end is approximately 44 mm.

Figure 6:
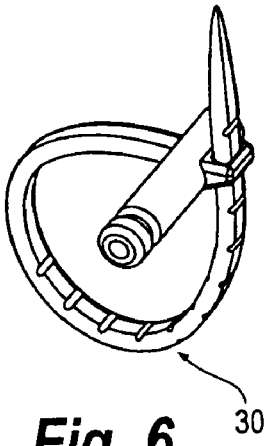
FIG. 6 shows a fixture for the earpiece according to a first embodiment of the invention, in a second state.

The branch 13 is made of a flexible, resilient material such as a polymer, a polyether block amide or a polyamide. The retainer 18 is likewise made of a flexible, resilient material such as polyamide, and comprises a strap that defines a tangential hole, adapted to receive an end of the branch 13. The branch 13 will be arrested once inserted into the retainer 18 by a rib of the peg engaging one of the grooves, biased by resilience of the strap. Once the branch 13 has been fixed in the retainer 18, as shown in FIG. 6, it forms a loop. This is referred to as the second state of the fixture. The size of the loop may vary depending on which of the grooves 24 in the branch 13 that interacts with the rib in the retainer 18. In this way it is possible to adjust the effective size of the loop to properly fit the users ear. In another embodiment the branch 13 has no grooves and may be connected to the peg 15 by gluing. For example, the branch 13 may be fixed in the retainer before gluing.

Figure 7:
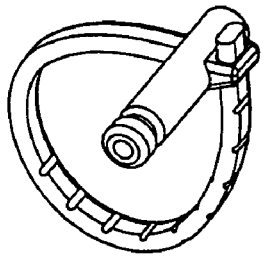
FIG. 7 shows a fixture for the earpiece according to a first embodiment of the invention, in a third state.

The protruding end of the branch 13 may be cut off, to reach the third state, which is shown in FIG. 7. The branch 13 has grooves on both faces in order that it is possible to form a loop either way around. In this way the branch 13 can be used for both a right ear and a left ear. Between the axis 16 and the base portion of the branch 13 there is an angle of approximately 60° so that when the branch 13 is fixed into the retainer 18, the loop will be twisted. In other embodiments of the invention this angle may vary between 45° and 90°. The convex side of the loop provides a contact surface 30, which may be in contact with concha 5, tragus 8, and the ear canal 10.

Figure 8:
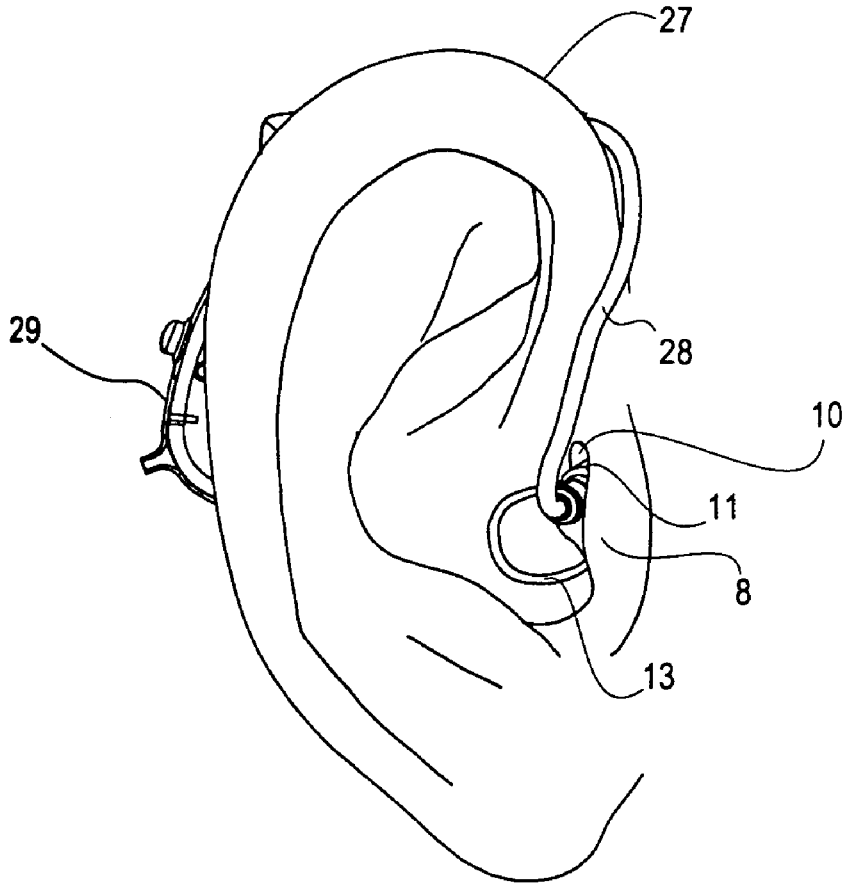
FIG. 8 shows a hearing aid according to a first embodiment of the invention, in the use position on the ear.

FIG. 8 shows a hearing aid with an earpiece according to the first embodiment of the invention. The earpiece is kept in a fixed position due to retention by the exterior of the branch 13, which provides the contact surface 30. The interaction between the branch 13, specifically the contact surface 30, and the inside of the tragus 8 and the interaction of the earplug with the ear canal 10, provides the retention of the earpiece. Also the two bends 27, 28 of the tube 26 provides for the earpiece to be kept in a fixed position in the ear.

Figure 9:
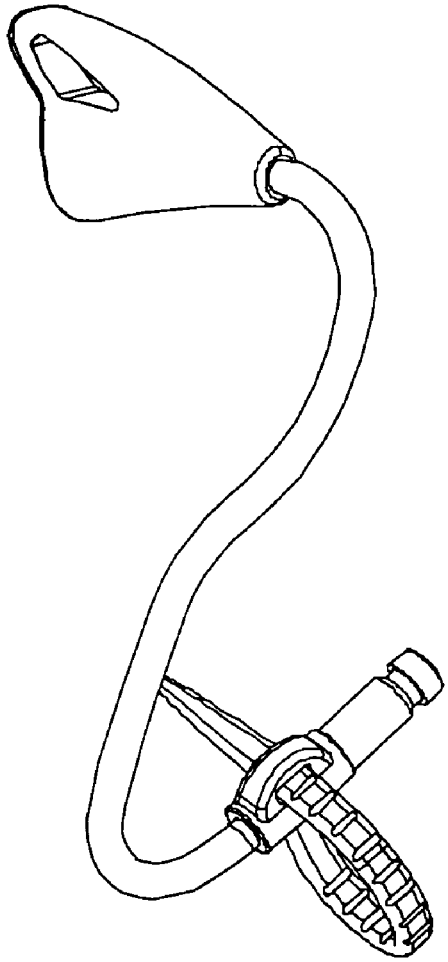
FIG. 9 shows a tube with a fixture according to a first embodiment of the invention, the fixture being in a second state.

FIG. 9 shows an earpiece with a tube 26 according to a first embodiment of the invention, in a second state, i.e. a state where the branch forms a loop with a protruding end.

Figure 10:
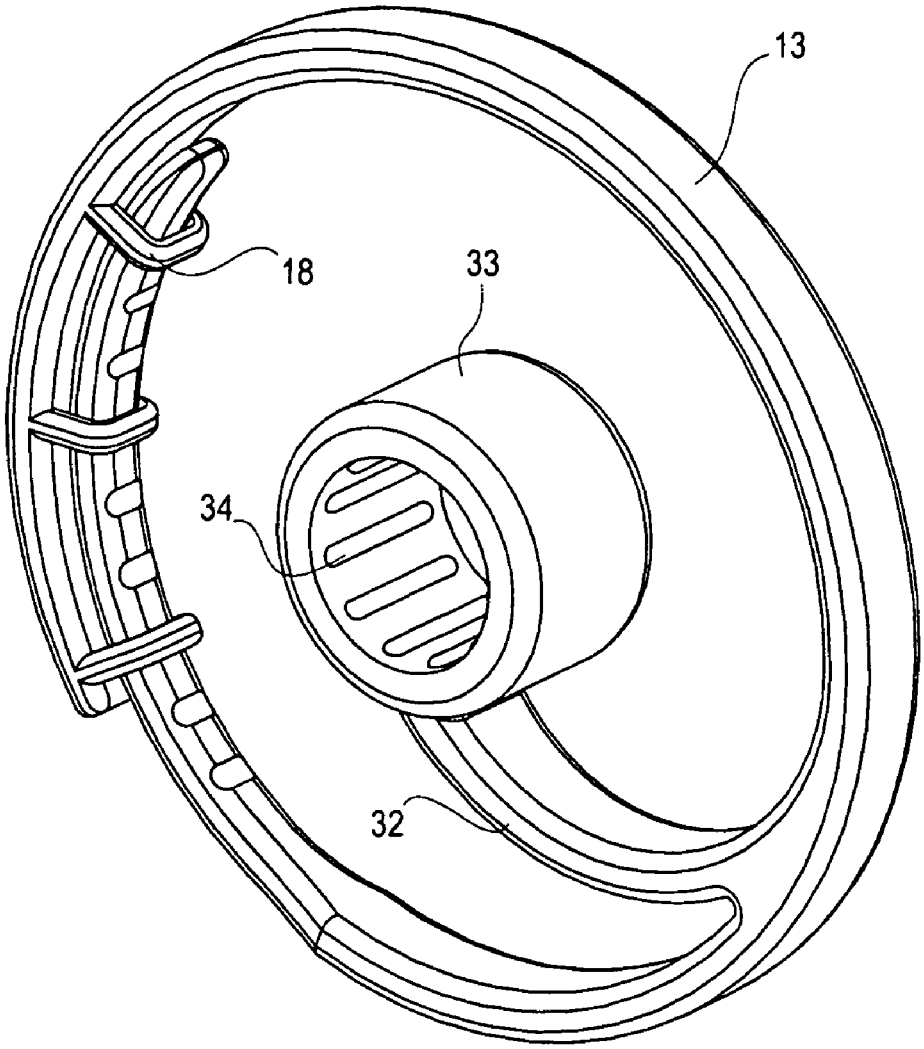
FIG. 10 shows a contact element according to a second embodiment of the invention, in a second state.

In an earpiece 36 according to a second embodiment of the invention, shown in FIG. 10, the branch 13 has one or more retainers 18 for fixation of the pointed end. The branch 13 has one or more spokes 32, which are connected to a hub 33. Once the pointed end of the branch 13 has been fixed, the branch 13 assumes an essentially circular shape. Part of the convex side of the fixed branch 13 provides a contact surface 30, which is in contact with the inside of tragus 8 or the ear canal 10 or both. The branch may be curved narrower along part of its length so that it assumes an essentially elliptic shape, once the pointed end has been fixed. The hub 33 has a number of notches 34.

Figure 11:
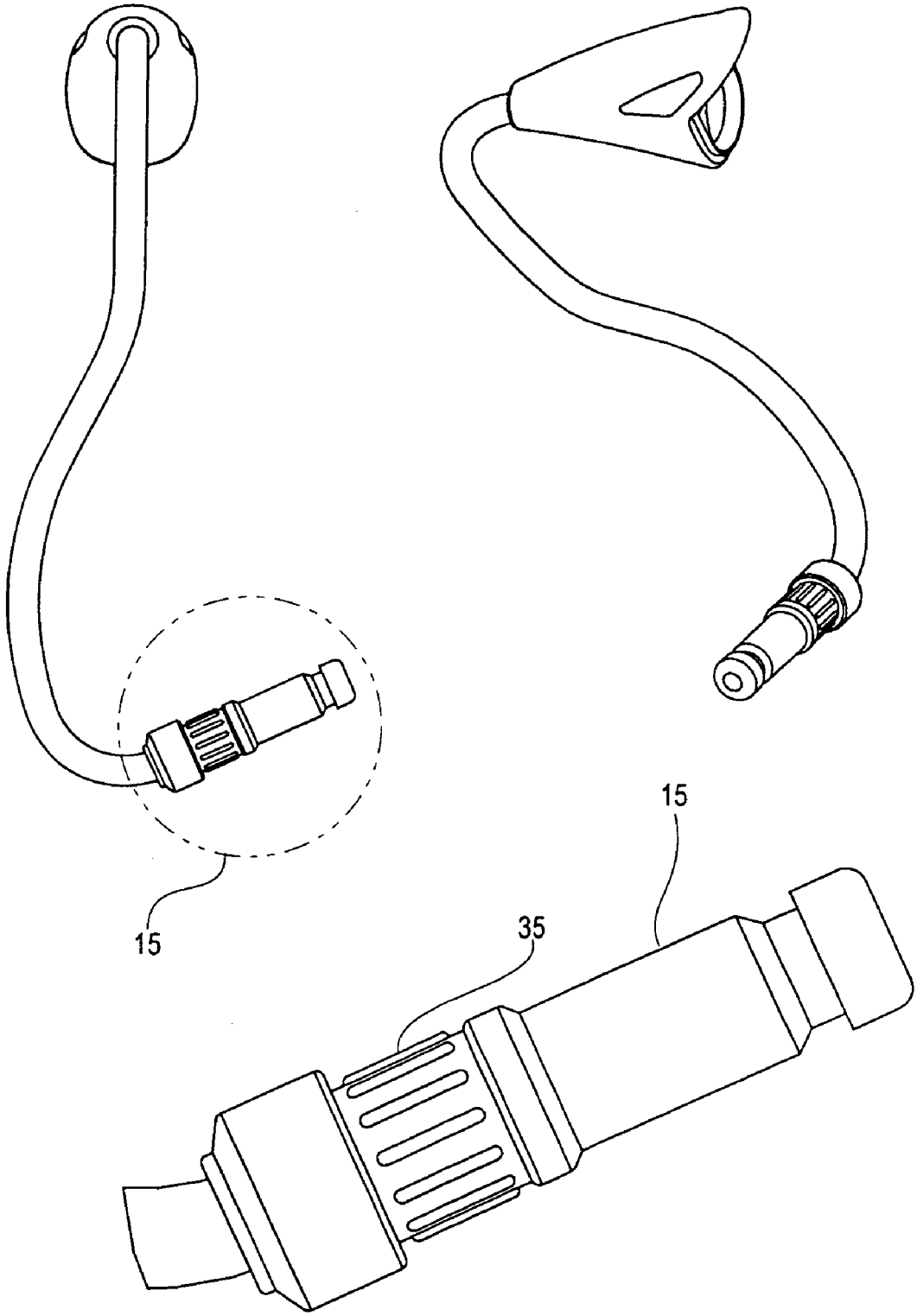
FIG. 11 shows part of a hearing aid with a fixture according to a second embodiment of the invention.

FIG. 11 shows a peg 37 of a second embodiment of the earpiece according to the invention, FIG. 11 including views of the peg 37 with the tube 26 from two different viewing angles as well as an enlarged view of the peg 37. The peg 37 comprises a number of protrusions 35 that match the notches 34 of the hub 33 (ref. FIG. 10). In this way the contact element may be rotated relative to the hub to a particular orientation selected for comfort and proper resting of the contact element behind tragus and in the ear canal, and then assembled so as to safely maintain the selected orientation.

Figure 12:
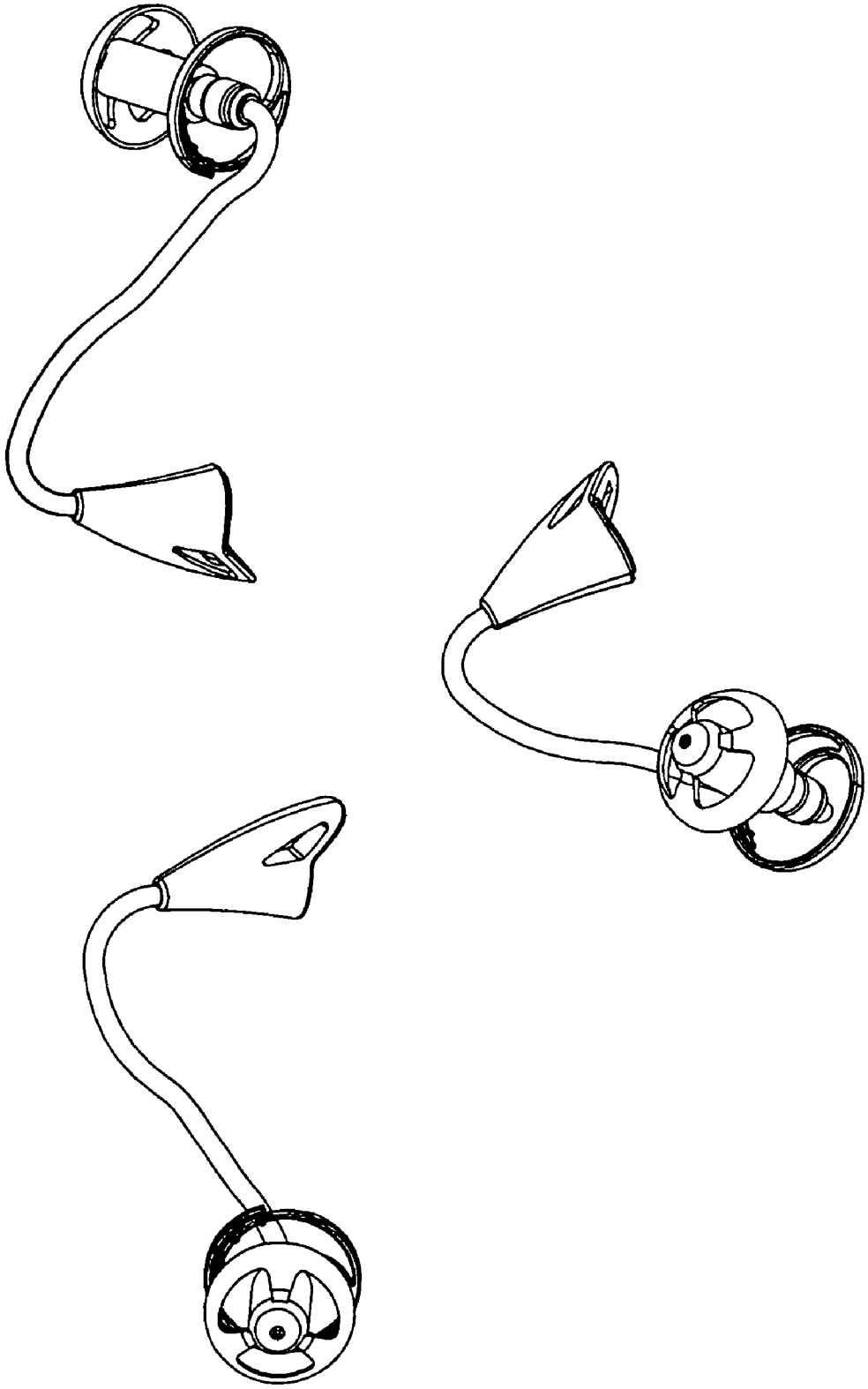
FIG. 12 shows part of a hearing aid with an earpiece according to a second embodiment of the invention.

FIG. 12 shows three views of a tube 26, an earplug 20 and an earpiece 36 according to the second embodiment of the invention.

Figure 13:
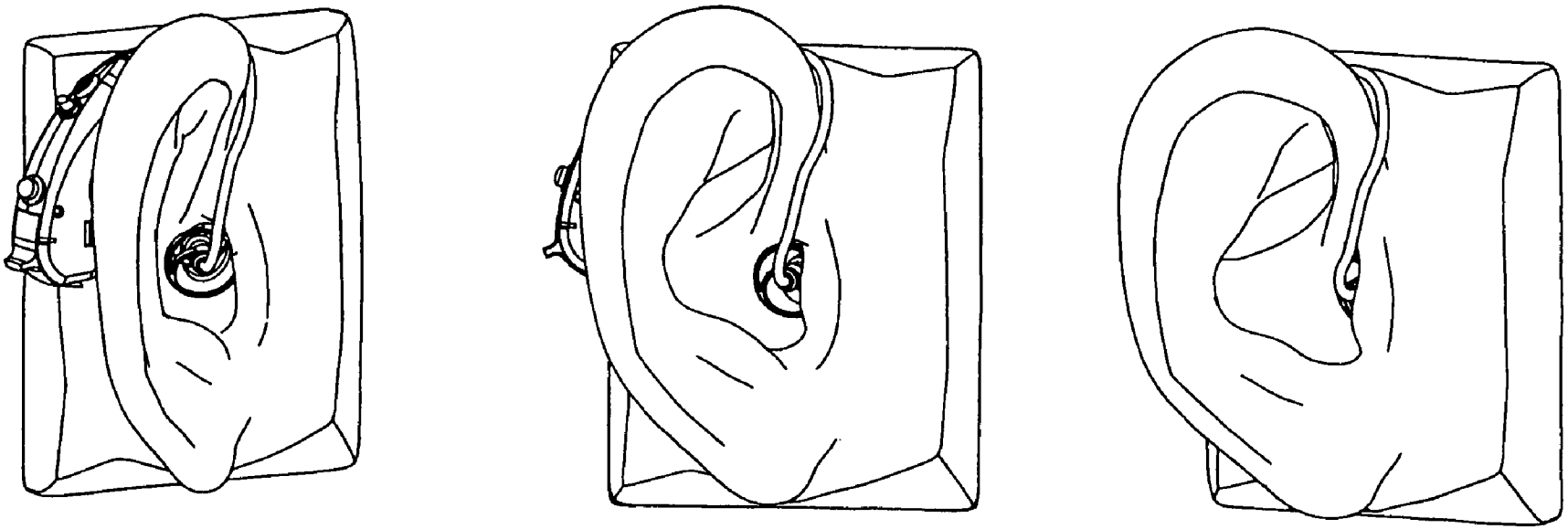
FIG. 13 shows a hearing aid according to the second embodiment of the invention, in the use position on the ear.

FIG. 13 shows three views of a hearing aid with housing 29, tube 26 and earpiece 36 according to the second embodiment of the invention in the use position on the ear.

Figure 14:
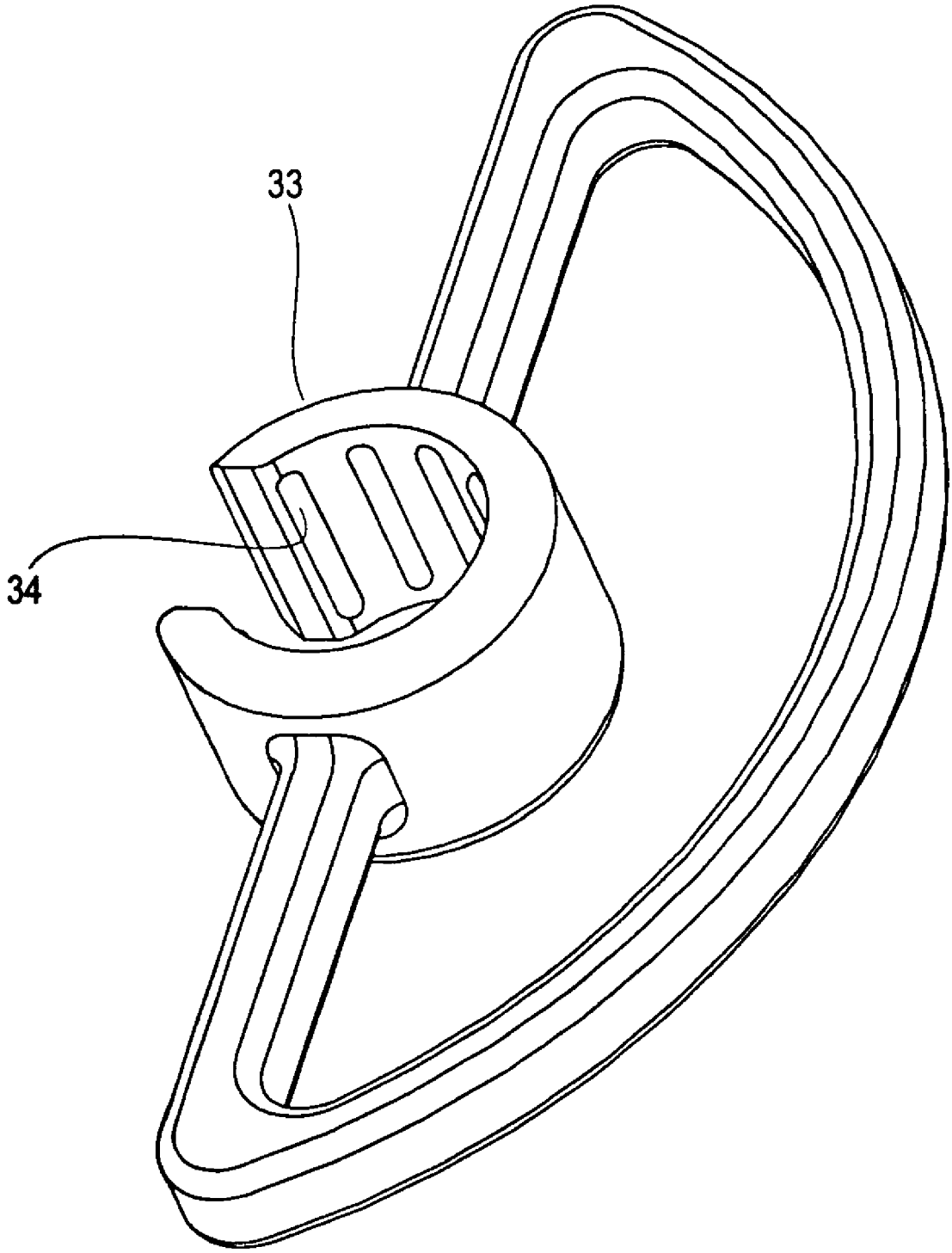
FIG. 14 shows a contact element according to a third embodiment of the invention.

FIG. 14 shows an earpiece 38 according to a third embodiment of the invention. This earpiece 38 comprises a contact element molded in a resilient material so as to have the general appearance of a half-circle. The contact element comprises a hub 39 comprising a number of notches 34.

Figure 15:
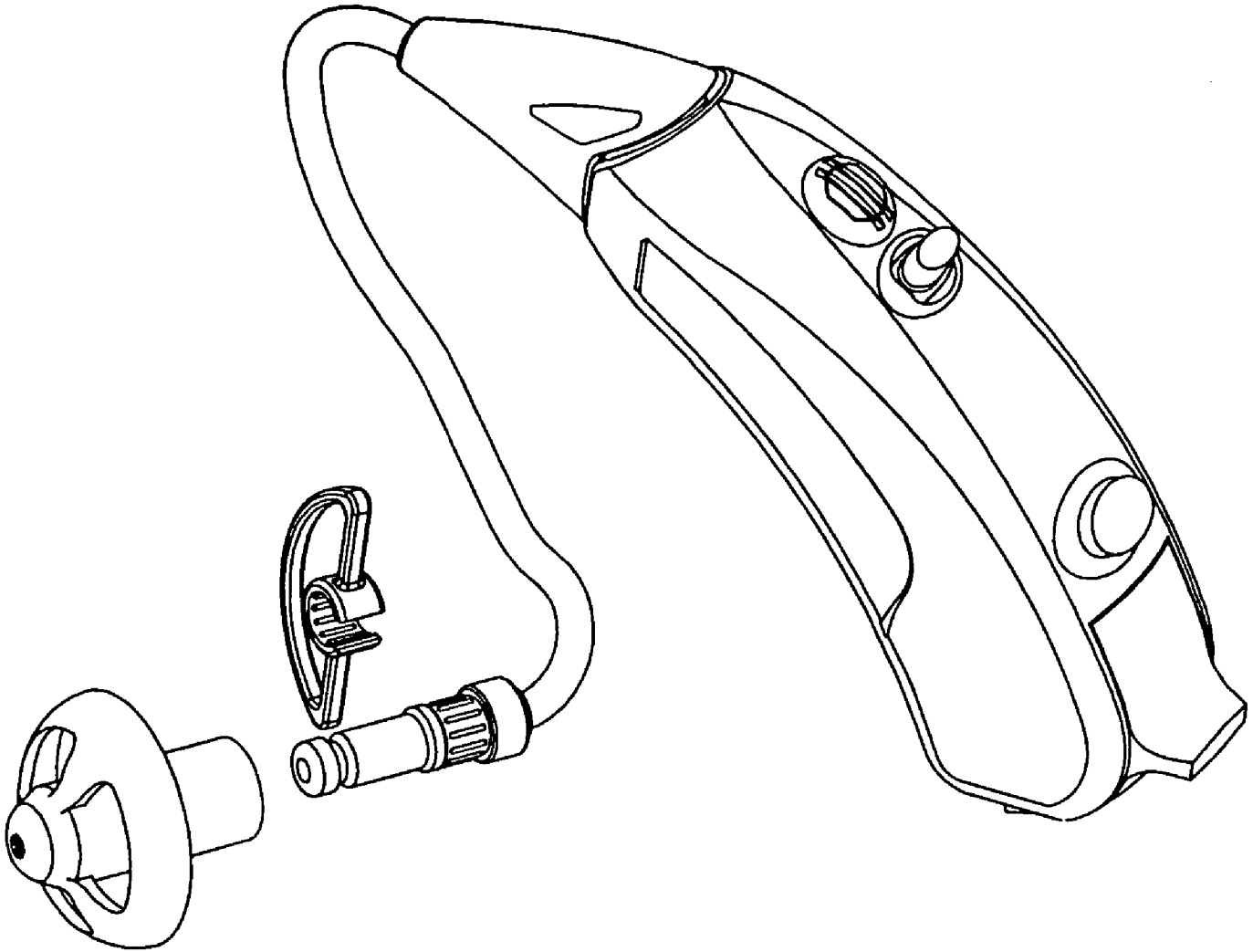
FIG. 15 shows an exploded view of a hearing aid with an earpiece according to a third embodiment of the invention.

FIG. 15 shows a hearing aid with housing 29, tube 26, earplug 20 and earpiece 38 according to the third embodiment, which may be clicked on a fixture (e.g. the peg 37 shown in FIG. 11). The contact element may be produced in different sizes for different sizes of ears.

Figure 16:
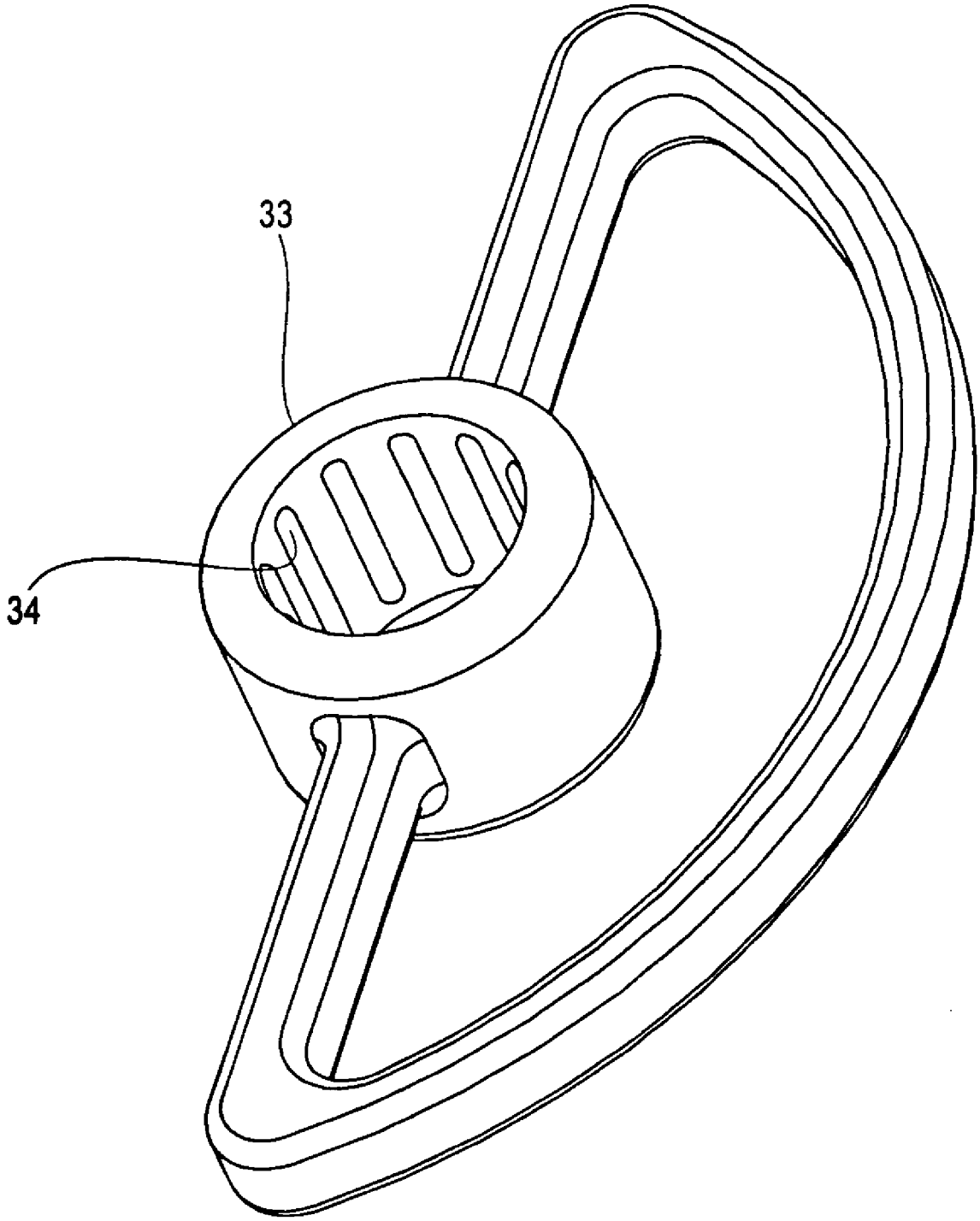
FIG. 16 shows a contact element according to a fourth embodiment of the invention.

FIG. 16 shows an earpiece 40 according to a fourth embodiment of the invention, this earpiece comprising a contact element molded in a resilient material so as to generally resemble a full circle. The earpiece 40 comprises hub 41 in a closed shape comprising a number of notches that match the peg 37 (ref. FIG. 11).

Figure 17:
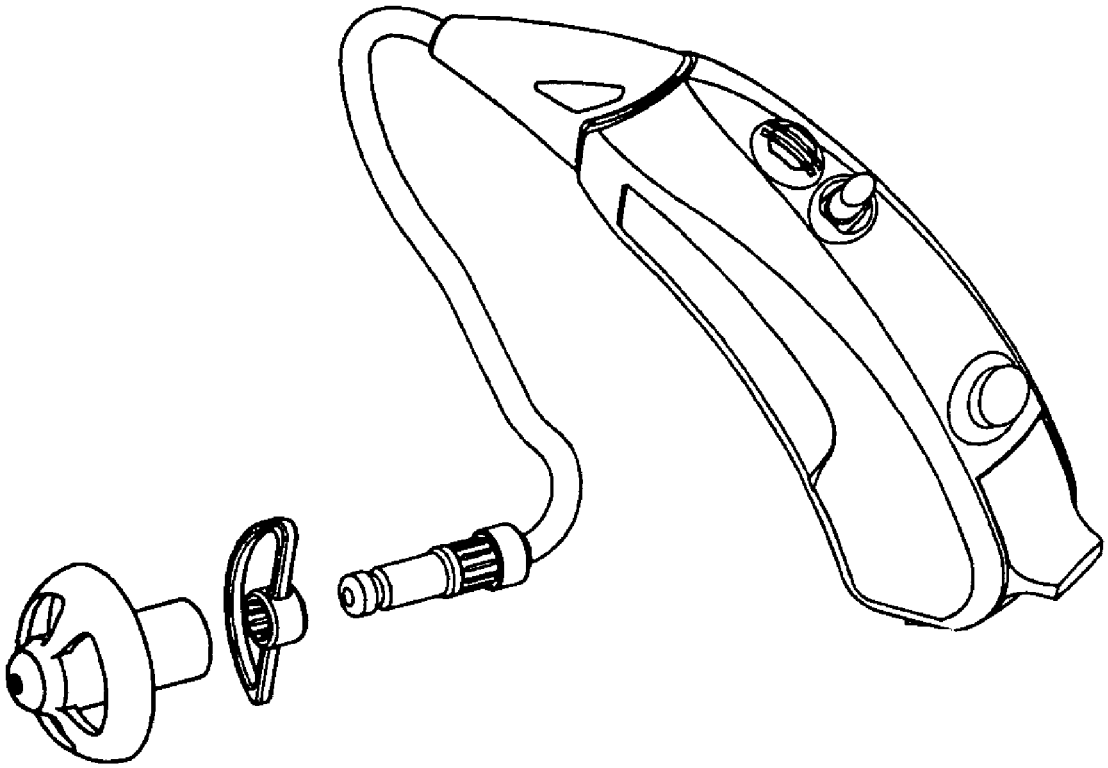
FIG. 17 shows an exploded view of a hearing aid with an earpiece according to a fourth embodiment of the invention.

FIG. 17 suggests how the contact element may be mounted on the fixture by pushing the hub 41 and then the earplug 20 onto the peg 37.

Figure 18:
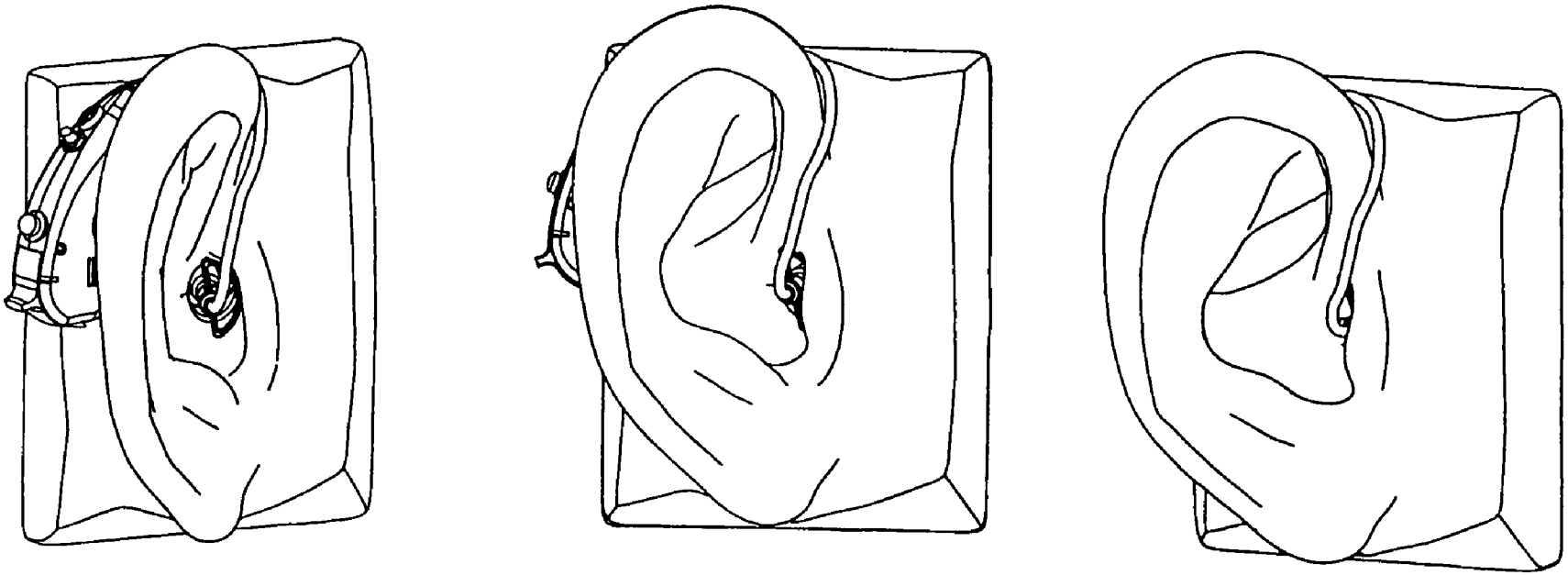
FIG. 18 shows a hearing aid with an earpiece according to the fourth embodiment of the invention, in the use position on the ear.

FIG. 18 shows three views of a hearing aid with housing 29, tube 26 and an earpiece 40 according to the fourth embodiment of the invention, in the use position on the ear.

We claim:

1. An earpiece for a hearing aid, the ear piece comprising
a plug for contacting the meatus of the users ear canal,
a contact element for resting against at least one of an inside of the users tragus and the ear canal,
means for adjusting the contact element, and
a fixture for holding the plug and the contact element together.

2. The earpiece according to claim 1, wherein the contact element is partially shaped as an ellipse.

3. The earpiece according to claim 1, wherein the fixture comprises a number of guideways.

4. The earpiece according to claim 1, wherein the contact element comprises a number of guideways.

5. The earpiece according to claim 1, wherein the means for adjusting the contact element is provided in the fixture.

6. The earpiece according to claim 5, wherein the fixture comprises resilient means adapted for resiliently spacing the plug from the contact element.

7. The earpiece according to claim 5, wherein the fixture is adapted for incremental adjustment of the spacing.

8. The earpiece according to claim 5, wherein the fixture comprises a flexible beam with a plurality of grooves and a catch means for selectively engaging one of the grooves.

9. The earpiece according to claim 8, wherein the beam comprises a pair of opposing, generally flat faces, and wherein the plurality of grooves is positioned on a first one of the faces.

10. The earpiece according to claim 9, wherein the beam is adapted for being bent into a loop, and wherein the fixture comprises catch means to retain an end of the beam.

11. The earpiece according to claim 10, wherein the catch means comprises a rib and a resilient strand, the rib being adapted for engaging one of the grooves.

12. The earpiece according to claim 10, wherein the beam is provided with a plurality of grooves on both of the faces.

13. The earpiece according to claim 8, wherein the earpiece comprises a body with an axis and a through axial bore, wherein the flexible beam extends from the body at an angle from the axis within a range of 45 to 90 degrees, and preferably within a range of 55 to 80 degrees from the axis.

14. The earpiece according to claim 1, wherein the fixture is made of a material selected from the group consisting of polyamide, silicone, polyurethane, polytetrafluoroethylene, ethylvinylacetate, polyacetal, TPE, polymer, elastomer, and polyoxymethylene.

15. The earpiece according to claim 1, comprising a plug for contacting the wall of the users ear canal.

16. The ear piece according to claim 15, wherein the plug is adapted to support a sound conduit tube and to provide an aperture to permit exterior sounds to reach the users inner ear.

17. A hearing aid comprising an earpiece, a housing, and a sound conduit tube, wherein said ear piece has a plug for contacting the meatus of the users ear canal;
a contact element for resting against at least one of an inside of the users tragus and the ear canal; means for adjusting the contact element; and a fixture for holding the plug and the contact element together.

18. The hearing aid according to claim 17, wherein the tube is semi-rigid and adapted to fit over the users external ear in order to support the hearing aid.

19. The hearing aid according to claim 18, wherein the tube has a first bend to fit over the users ear and a second bend to direct the tube towards the users ear canal.

* * * * *